US005935750A

United States Patent [19]

Barbetta et al.

[11] Patent Number: 5,935,750

[45] Date of Patent: Aug. 10, 1999

[54] COATED CARRIER

[75] Inventors: Angelo J. Barbetta, Penfield; Robert D. Bayley, Fairport; Carol A. Fox, Canandaigua; Thomas R. Hoffend, Webster; Scott M. Silence, Fairport; K. Derek Henderson, Rochester, all of N.Y.; Paula J. MacLeod, Elobicoke, Canada; Charles H. Honeyman, Boston, Mass.; Thomas E. Enright, Bradford, Canada

[73] Assignee: Xerox Corporation, Stamford, Conn.

[21] Appl. No.: 09/140,998

[22] Filed: Aug. 26, 1998

[51] Int. Cl.[6] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 3,533,835 | 10/1970 | Hagenbach et al. | 430/108 |
| 3,590,000 | 6/1971 | Palermiti et al. | 430/110 |
| 3,658,500 | 4/1972 | Hagenbach | 430/108 |
| 3,798,167 | 3/1974 | Kukla et al. | 430/108 |
| 3,918,968 | 11/1975 | Kukla et al. | 430/108 |
| 3,922,382 | 11/1975 | Kukla et al. | 430/108 |
| 3,939,086 | 2/1976 | Hagenbach | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,298,672 | 11/1981 | Lu | 430/108 |
| 4,310,611 | 1/1982 | Miskinis | 430/107 |
| 4,338,390 | 7/1982 | Lu | 430/106 |
| 4,397,935 | 8/1983 | Ciccarelli et al. | 430/110 |
| 4,434,220 | 2/1984 | Abbott et al. | 430/108 |
| 4,560,635 | 12/1985 | Hoffend et al. | 430/106.6 |
| 4,810,611 | 3/1989 | Ziolo et al. | 430/106.6 |
| 4,912,005 | 3/1990 | Goodman et al. | 430/108 |
| 4,935,326 | 6/1990 | Creatura et al. | 430/108 |
| 4,937,166 | 6/1990 | Creatura et al. | 430/108 |
| 5,215,848 | 6/1993 | Ikeda et al. | 430/106.6 |
| 5,230,980 | 7/1993 | Maniar | 430/108 |
| 5,340,677 | 8/1994 | Baba et al. | 430/108 |
| 5,376,494 | 12/1994 | Mahabadi et al. | 430/137 |

FOREIGN PATENT DOCUMENTS

| | | | |
|---|---|---|---|
| 60-213962 | 10/1985 | Japan | 430/108 |
| 4-199063 | 7/1992 | Japan | 430/108 |

*Primary Examiner*—Roland Martin
*Attorney, Agent, or Firm*—E. O. Palazzo

[57] ABSTRACT

A carrier comprised of a core and a polymer coating containing a quaternary ammonium salt functionality.

30 Claims, No Drawings

COATED CARRIER

PENDING APPLICATIONS

Illustrated in copending applications U.S. Ser. No. 140,437; U.S. Ser. No. 140,524; U.S. Ser. No. 140,594; and U.S. Ser. No. 140,439; all filed concurrently herewith, and the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in copending application U.S. Ser. No. 140,437 a carrier comprised of a core, and thereover a polymer of styrene, an olefin and a dialkylaminoalkyl methacrylate; in copending application U.S. Ser. No. 140,437 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; in copending application U.S. Ser. No. 140,594 a carrier comprised of a core and thereover a polymer or polymers of (1) methylmethacrylate and a monoalkyl aminoalkyl methacrylate, or (2) a polymer or polymers of methylmethacrylate and dialkylaminoalkyl methacrylate; and in copending application U.S. Ser. No. 140,439 a carrier comprised of a core and a polymer coating of (1) styrene/monoalkylaminoalkyl methacrylate or (2) styrene/dialkylaminoalkyl methacrylate.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions comprised of a core and thereover polymers containing a quaternary ammonium salt functionality. The quaternary ammonium salt can be contained in a copolymer such as polymethylmethacrylate-co-polyvinylbenzyltriethyl ammonium chloride or a terpolymer such as polystyrene-co-poly-n-butylacrylate-co-polyvinylbenzyltriethyl ammonium chloride. Alternatively, the quaternary ammonium site may be formed by reacting a suitable amine-containing polymer with a suitable halogen-containing polymer to form a polymer crosslinked with quaternary ammonium sites, such as polystyrene-co-poly-(n-butylacrylate)-co-poly(vinylbenzyl chloride) reacted with poly(dimethylaminoethyl methacrylate)-co-polystyrene to form polymers crosslinked with quaternary ammonium salt sites.

The present invention relates to carrier particles comprised of a core with a coating thereover of a polymer containing quaternary ammonium salt sites. The substituents on the nitrogen of the ammonium salt site can be aliphatic like alkyl, aromatic like aryl, or mixtures thereof and the anion can be a halogen (Cl, F, Br, I), sulfate, phosphate, and the like. The backbone of the polymer can be polymers of one or more of the following styrene, n-butyl acrylate, butadiene, chloromethylstyrene, methylmethacrylate, dimethylaminoethyl methacrylate, diethylaminoethyl methacrylate, dibutylaminoethyl methacrylate, and the like. Alternatively, the ammonium salt containing polymer may be formed by reaction of two appropriate polymers to form a quaternary ammonium salt site. One polymer may be an amine containing polymer such as homopolymers or copolymers containing, for example, dialkylaminoalkyl methacrylates such as dimethylaminoethyl methacrylate, diethylaminoethyl methacrylate, diisopropylaminoethyl methacrylate, dibutylaminoethyl methacrylate. The second polymer contains sites that would react with the amine to form a crosslink, such as reactive halogens, for example homopolymers or copolymers of polyvinylbenzyl chloride (or fluoride, or iodide, or bromide), or allyl chloride (or fluoride, or iodide, or bromide). Moreover, the copolymer coating may contain a conductive component, such as carbon black, and which conductive component is preferably dispersed in the polymer coating. With the conductive component, there can be enabled, for example carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. An advantage associated with the carriers of the present invention include a triboelectrical charge, for example a carrier tribo range of from about a plus (positive charge) 50 to about 150, or to about 95 microcoulombs per gram, and preferably from about a positive 55 to about a positive 90 microcoulombs per gram, and most preferably from a positive about 60 to a positive about 70 microcoulombs per gram.

The carrier particles of the present invention can be selected for a number of different xerographic copiers and printers, such as high speed color xerographic copies, printers, digital copiers, and more specifically wherein colored copies with excellent and substantially no background deposits are achievable in copiers, printers, digital copiers, and the combination of xerographic copiers and digital systems. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core and the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith.

Carrier particles for use in the development of electrostatic latent images are described in many patents including, for example, U.S. Pat. No. 3,590,000. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where part of, or the entire coating may separate from the carrier core in the form of chips or flakes, and fail upon impact, or abrasive contact with machine parts and other carrier particles. These flakes or chips, which cannot generally be reclaimed from the developer mixture, usually adversely affect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low tribo as compared to the high tribo carriers of the present invention.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The present invention has the advantage over the prior art of achieving high positive triboelectric charge on the carrier particles, that is, high negative triboelectric charge is imparted to the toner particles developed onto a photoreceptor in a xerographic development environment. Further, the full range of electrical properties of the carrier particles can be achieved at high triboelectric charging values, from carrier conductivities of $10^{-17}$ mho/cm to $10^{-6}$ mho/cm, that is, from the insulative to the conductive regime.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high triboelectric charging values with finely divided toner particles; and also wherein the carrier particles in embodiments are of substantially constant conductivity.

When resin coated carrier particles are prepared by powder coating process the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of from a positive triboelectric charge of positive about 20 to a positive of about 150, and for example from a positive about 45 to a positive about 90, microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles and having contained therein conductive particles of for example, carbon black.

Other U.S. Patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. No. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided dry or solution coating processes for generating carrier particles of substantially constant conductivity parameters, and high triboelectric charging values.

In yet a further feature of the present invention there are provided carrier particles with high tribo values of at least about 50 microcoulombs per gram, and wherein the carrier includes thereover a copolymer containing an ammonium salt functionality, and wherein the coating may contain therein a conductive component of for example, carbon black.

Aspects of the present invention include a carrier comprised of a core and a polymer coating containing a quaternary ammonium salt functionality; a carrier wherein the quaternary ammonium salt is an alkyl or an aryl salt, and the anion thereof is a halogen, sulfate, or phosphate, and wherein salt includes a polymer backbone of methylmethacrylate, styrene, n-butyl acrylate, dialkylaminoalkyl methacrylate, butadiene, vinylbenzyl chloride, or mixtures thereof; a carrier wherein the quaternary ammonium salt is prepared by reacting two appropriate polymers of a reactive halogen containing polymer and an amine containing polymer to form a crosslinked polymer where the crosslinks are quaternary ammonium salt sites; a carrier wherein the halogen polymer coating contains a vinylbenzyl halide (Br, Cl, I, F), or an allyl halide, and the amine copolymer contains an amine of dimethylaminoethyl methacrylate, diethylaminoethyl methacrylate, or vinyl pyridine; a carrier wherein the polymer coating is a copolymer of methylmethacrylate or styrene and a vinylbenzyltrialkyl ammonium halide; a carrier wherein the amine containing polymer coating is selected in excess, and the resulting polymer contains quaternary ammonium salt crosslinks and free amines; a carrier wherein the polymer coating contains from about 0.5 to about 20 weight percent of a quaternary ammonium salt; a carrier wherein the polymer coating is of an $M_w$, weight average molecular weight, of from about 50,000 to about 200,000; a carrier wherein the polymer coating is a copolymer and the coating weight thereof is from about 0.1 to about 20 weight percent; a carrier wherein the polymer coating weight is from about 1 to about 3 weight percent; a carrier wherein the polymer coating contains a conductive component; a carrier wherein the conductive component is a metal oxide, or carbon black; a carrier wherein the conductive component is carbon black selected in an amount of from about 10 to about 60 weight percent; a carrier wherein the core is a known component such as metal, a metal oxide, or a ferrite; a carrier with a triboelectric charge of from about a positive 20 to about a positive 100 microcoulombs per gram; a carrier with a triboelectric charge of from about a positive 30 to about a positive 50 microcoulombs per gram; a developer comprised of carrier and toner; a developer wherein the toner is comprised of thermoplastic resin and colorant; a developer wherein the colorant is a pigment or a dye; a developer comprised of (1) a carrier core and coating layer of copolymers of a methacrylate and a quaternary ammonium salt, and (2) a toner; a developer wherein the carrier core is selected from the group consisting of iron, ferrites, steel and nickel; a developer with a carrier triboelectric charge of from about a positive 20 to about a positive 75 microcoulombs per gram, and a toner triboelectric charge of from about a negative 20 to about a negative 75 microcoulombs per gram, or with a carrier charge of from about a positive 25 to about a positive 40 microcoulombs per gram, and a toner triboelectric charge of from about a negative 25 to about a negative 40 microcoulombs per gram; a carrier wherein the polymer coating is a copolymer of methylmethacrylate/dimethyl aminoethyl methacrylate/polyvinylbenzyl triethylammonium chloride; a copolymer of methylmethacrylate and tertiary-butylaminoethyl methacrylate and polyvinylbenzyl triethylammonium chloride; a copolymer of methylmethacrylate and diethylaminoethyl methacrylate and polyvinylbenzyl triethylammonium chloride, a copolymer of methylmethacrylate and diisopropylaminoethyl methacrylate and polyvinylbenzyl triethylammonium chloride; or a copolymer of methylmethacrylate and polyvinylbenzyl triethylammonium chloride with alkylaminoethyl methacrylates; a carrier wherein the carrier contains a second polymer coating; a carrier wherein the second coating is comprised of a suitable polymer such as styrene acrylate, styrene methacrylate, a fluoropolymer, or mixtures thereof; a carrier wherein the second coating is comprised of a polyurethane, and which polyurethane optionally contains dispersed therein conductive components; a carrier wherein the second coating is comprised of a polyurethane/polyester; a carrier comprised of a core and thereover copolymers of methylmethacrylate and vinylbenzyl trialkyl ammonium salts, copolymers of methylmethacrylate and vinyl benzyl pyridinium chloride, copolymers of styrene and vinylbenzyl trialkyl ammonium salts, copolymers of styrene and vinyl benzyl pyridinium chloride, copolymers of styrene and acrylate and vinylbenzyl trialkyl ammonium salts, or copolymers of styrene, acrylate and vinyl benzyl pyridinium chloride; a process wherein the carrier particles can be prepared by mixing a carrier core such as low density porous magnetic, or magnetically attractable metal core carrier particles with from, for example, between about 0.05 percent and about 5 percent by weight, based on the weight of the coated carrier particles, of polymers, and which polymers or polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter; a composition comprised of a core, and thereover an ammonium salt containing copolymer present in an amount of from about 0.05 to about 20, and preferably to about 5 weight percent of the total carrier composition, and which carrier coating may optionally contain a conductive component, such as a metal oxide, or a pigment, like preferably carbon black, wherein the conductive component is selected in an amount of from about 10 to about 75 weight percent, and preferably from about 15 to 50 weight percent, based on the sum of the ammonium salt containing polymer and conductive component; a carrier comprised of two crosslinked polymers thereover, wherein the first polymer is a nitrogen-containing copolymer and wherein the conductive component for the either the first or second polymer is a metal oxide, or a pigment like preferably carbon black selected in an amount of from about 10 to about 50 weight percent, and wherein the second polymer reacts with the nitrogen-containing polymer to form polymers with quaternary ammonium complex crosslinks as illustrated herein, that is for example, a copolymer containing vinylbenzyl chloride such as polystyrene-co-poly(n-butyl acrylate)-co-polyvinylchloride which reacts with, for example, polymethylmethacrylate-co-poly(dimethylaminoethyl methacrylate), and, wherein the first polymer is selected in an amount of from about 1 to about 100, or from about 10 to about 75 weight percent, based on the total weights of all polymers and conductive components present in the carrier and the second polymer is selected in an amount of from about 99 to about 0, or from about 90 to about 25 weight percent, based on the total weights of all polymers and conductive components present in the carrier; and wherein the carrier core is a metal, a ferrite, a metal oxide, and the like such as known carrier cores. Also optionally, an additional polymer may be included in the carrier composition together with the ammonium salt containing copolymer, and wherein the additional polymer comprises a second polymer in the carrier composition, or together with two crosslinked polymers which form the quaternized functionality, wherein this additional polymer comprises a third polymer in the carrier composition. This additional polymer, which is neither quaternized nor participates in the quaternization reaction, comprises between 0 and 99 percent by weight of the total weight of all polymers.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and also for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D. M. Steward Corporation or Powdertech Corporation, Ni/Zn-ferrite available from Powdertech Corporation, Sr (strontium)-ferrite, containing for example about 14 percent strontium oxide and 86 percent iron oxide and available from Powdertech Corporation and Ba-ferrite, magnetites, available for example from Hoeganaes Corporation (Sweden), nickel, mixtures thereof, and the like. Preferred carrier cores include ferrites, and sponge iron, or steel grit with an average particle size diameter of from between about 30 microns to about 200 microns.

Examples of copolymers selected for the carrier include polymers containing a quaternary ammonium salt group, and more specifically, polymers generated from the reaction two suitable polymers, for example an amine containing polymer and a benzyl halogen containing polymer, such that when crosslinked forms a quaternary ammonium salt link.

That quaternary ammonium salt can be, for example, vinylbenzyltrimethyl ammonium chloride contained in random or block format in a copolymer of one or more of, for example, n-butyl acrylate, styrene, dimethylaminoethyl methacrylate, diethylaminoethyl methacrylate, diisopropylaminoethyl methacrylate, or t-butylaminoethyl methacrylate or vinyl pyridine. Specific examples of copolymer coatings are poly(methylmethacrylate)-co-poly(dimethylaminoethyl methacrylate)-co-poly(vinylbenzyltriethylammonium chloride), poly(methylmethacrylate)-co-poly(dimethylaminoethyl methacrylate)-co-poly(vinylbenzyl pyridinium chloride), polystyrene-co-poly(n-butylacrylate)-co-poly(vinylbenzyltriethylammonium chloride), polystyrene-co-poly(n-butylacrylate)-co-poly(vinylbenzyl pyridinium chloride), poly(methylmethacrylate)-co-poly(vinylbenzyltriethylammonium chloride), poly(methylmethacrylate)-co-poly(vinylbenzyl pyridinium chloride), poly(methylmethacrylate)-co-poly(n-butylacrylate)-co-poly(vinylbenzyltriethyl ammonium chloride); polystyrene-co-poly(n-butyl acrylate)-co-poly(vinyl benzyl chloride) crosslinked with polystyrene-co-poly(dimethylaminoethyl methacrylate), and poly(methylmethacrylate)-co-poly(dimethylaminoethyl methacrylate) crosslinked with polymethylmethacrylate-co-poly(vinylbenzyl chloride). The monomers for synthesizing the above polymers are obtained from Aldrich Chemical Company with regard to styrene, chloromethylstyrene, n-butyl acrylate, dimethylaminoethyl methacrylate, diethyl aminoethyl methacrylate, 4-vinyl pyridine and methylmethacrylate, and Scientific Polymer Products in the case of diisopropylaminoethyl methacrylate and t-butylaminoethyl methacrylate. Synthetic methods for the preparation of polymers and copolymers from these monomers may be bulk polymerization, solution polymerization, emulsion polymerization, suspension or semisuspension polymerization or any other known suitable polymerization methods.

The polymers can also be prepared by bulk polymerization which can be accomplished with monomers in the absence of solvent, and by solution polymerization can be effected in a solvent medium, such as toluene, in which the monomer or mixture of monomers is combined with a suitable initiator, such as 2,2'-azobis(2-methylpropionitrile), referred to as AIBN, and reacted for an effective period of time, for example from about 7 to about 15, and preferably about 11 hours, at an elevated temperature, for example 70° C. From this reaction, a solution with a solids content of about 22.7 percent by weight polymer can be obtained, in which the polymer has a glass transition of about 108.0° C., and molecular weight by gel permeation chromatography of $M_w$=90,000 with molecular weight dispersibility, that is the ratio of $M_w/M_n$, or MWD =about 2.3.

The suspension polymerization method involves mixing monomers and initiator, such as AIBN, to obtain a clear organic phase. The organic phase is then combined with an aqueous solution of Air Products Airvol 603 Polyvinyl Alcohol, and potassium iodide aqueous phase inhibitor. The desired particle size is obtained by homogenizing the two phases with a Brinkman homogenizer equipped with a Polytron Generator with three stationary and three moving rings of flat rotor design for five minutes at about 8,000 RPM. The resulting suspended organic phase is then transferred to the preheated reactor and stirred at about 65 RPM to maintain stability of the suspension. The suspension is then maintained at 70° C. for 6 hours and 40 minutes to complete polymerization. The polymer suspension is then cooled, removed from the reactor, washed and centrifuged 5 times with a 90/10 volume ratio of methanol/water and finally washed with water only. The wet polymer suspension is then air dried, placed in a vacuum oven at from about 40.0 to 80.0° C. to complete drying, and further broken down to its primary particle size by ball milling followed by screen sieving. This process yields a polymer particle size having a volume median of about 4.0 $\mu$, a second pass glass transition onset temperature of 95.8° C., and a molecular weight by gel permeation chromatography of about $M_w$=520,000 with an about MWD =2.2

Emulsion polymerization is accomplished by the continuous addition to a suitable reaction vessel containing water, and providing mechanical stirring, nitrogen atmosphere, and thermostatic control, a mixture of monomers and an initiator, such as ammonium persulfate initiator, as obtained from the Aldrich Chemical Company, (0.2 to 0.6 percent by weight of monomers). The polymerization effected by heating to, for example, between about 55 and about 65° C. to achieve molecular weights, $M_w$ by gel permeation chromatography ranging from, for example, about 200,000 to about 500,000. The polymer or copolymer powder is isolated by freeze drying in vacuo, the residue free latex. The resulting polymer particle diameter size is, for Hiexample, 0.1 to 2.0 microns in volume average diameter.

The polymer coating preferably has dispersed therein in embodiments conductive components, such as metal oxides like tin oxide, conductive carbon blacks, and the like, in effective amounts of, for example, from about 0 to about 70, and preferably from about 15 to about 60 weight percent. Specific examples of conductive components include the conductive carbon black SC Ultra available from Conductex, Inc., and antimony-doped tin oxide Zelec ECP3005-XC manufactured by E. I. DuPont.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxy phenyl)azo]-3-(mono-substituted)-2-naphthalenolato(2-)] chromate(1-), ammonium sodium and hydrogen (TRH), cetyl pyridinium chloride (CPC), FANAL PINK® D4830, and the like, including those as specifically illustrated herein, and other effective known charge agents or additives. The charge additives are selected in various effective amounts, such as from about 0.05 to about 15, and from about 0.1 to about 3 weight percent, based on the sum of the weights of all polymer, conductive additive, and charge additive components.

Examples of an additional carrier coating polymer which is neither quaternized nor participates in the quaternization reaction in the carrier composition selected can include polymonoalkyl or dialkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like. Other known related polymers not specifically mentioned herein may also be selected, such as those illustrated in the U.S. Pat. Nos. 4,937,166 and 4,935,326 patents mentioned herein.

Another additional polymer which is neither quaternized nor participates in the quaternization reaction in the carrier composition is comprised of a thermosetting polymer, more specifically a poly(urethane) thermosetting resin which contains, for example, from about 75 to about 95, and preferably about 80 percent by weight of a polyester polymer, which, when combined with an appropriate crosslinking agent, such as isopherone diisocyannate and initiator such as dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. This additional polymer is present in an amount of from about 0 percent to about 99, or from about 35 to about 70 percent by weight, based on the total weight of the first and second polymers and the conductive component in the first polymer.

The advantages of the carriers of the present invention include in embodiments high robust carrier tribo charge of a positive value, high toner tribo charge of a negative value, excellent admix, for example, from about 1 to about 30 seconds as determined in the charge spectrograph, and the like. More specifically, the toner tribo is from about a minus 50 to about a minus 150, from about a minus 55 to about a minus 90, or from about a minus 60 to about a minus 85, with corresponding positive tribo charges for the carrier. The tribo charges can be determined by a number of known methods, such as the use of a Faraday Cage.

Other advantages of the present invention include increased resistance of the carrier to mechanical aging in a xerographic environment and a decreased sensitivity of the carrier triboelectric value to the relative humidity of the environment. With respect to high toner tribo charge of a negative value, this property is important to xerographic, especially color applications, primarily because there is enabled development of toner particles into regions of the imaging member, such as a photoreceptor where strong fringe electrical fields exist, that is at the borders of solids areas and lines. Developing toner particles through these fringe fields minimizes or eliminates the untoned part of the image which appears between two adjacent colors in an image.

Various effective suitable processes can be selected to apply the polymer, or mixture, for example from 2 to about 5, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm-$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of, for example, from about 1 percent by weight to about 20, and preferably from about 5 to about 12 percent by weight, based on the total weight of the toner components, however, lesser or greater amounts of pigment may be selected. Colorants include dyes, pigments, mixtures thereof, mixtures of dyes, mixtures of pigments, and the like.

When the colorant particles are comprised of magnetites, which are a mixture of iron oxides ($FeO \cdot Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as Cl 60720, Cl Dispersed Red 15, a diazo dye identified in the Color Index as CI 26050, Cl Solvent Red 19, and the like. Examples of cyans that may be used include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, can be selected. These colorants, especially pigments, are generally present in the toner composition in an amount of from about 1 weight percent to about 15, and for example, from about 2 to about 12 weight percent based on the weight of the toner components of binder and pigment.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product. Toner particles sizes and shapes are known and include for example a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with this developer composition possess, for example, acceptable solids, excellent halftones, and desirable line resolution with acceptable or substantially no background deposits excellent chroma, superior color intensity, constant color chroma and intensity over extended time periods, such as 1,000,000 imaging cycles, and the like.

The following Examples are being supplied to further define the present invention, it being noted that these Examples are intended to illustrate and not limit the scope of the present invention. Parts and percentages are by weight unless otherwise indicated.

SYNTHETIC EXAMPLE I

A chloromethylstyrene (5 to 15 mol percent) containing polymer was prepared as follows. A solution of styrene (225 grams, 2.16 mol; obtained from Fluka Chemie AG), chloromethylstyrene (isomer mixture, 16.4 grams, 0.11 mol; obtained from Dow Chemical), n-butyl acrylate (14 grams, 0.11 mol, obtained from Aldrich Chemical), benzoyl peroxide (2.4 grams, 0.011 mol; obtained from Aldrich Chemical) and 2,2,6,6-tetramethyl-1-piperidinyloxy free radical (TEMPO; 1.8 grams, 0.011 mol, obtained from Aldrich Chemical) was stirred and heated, under argon, in an oil bath maintained at 135° C. for 6.25 hours. The resultant polymeric material was isolated by precipitation into stirring methanol and recovered as a coarse powder. Recovered polymer was then dried in vacuo at room temperature, about 25° C. throughout, for 24 hours which resulted in the isolation of a fine white free flowing powder. The molecular weight properties of the resulting random copolymer poly (styrene-con-butylacrylate-cochloromethylstyrene) having a monomer ratio of 90.7 percent styrene, 4.6 percent n-butylacrylate, 4.6 percent chloromethylstyrene (isomer mixture) by mole are shown in Table xx.

SYNTHETIC EXAMPLE II

This procedure of Synthetic Example I was repeated to generate another chloromethylstyrene (5 to 15 mol percent) containing polymer, using the following amounts of monomers: styrene (213 grams, 2.04 mol), chloromethylstyrene (isomer mixture, 32.8 grams, 0.22 mol), and n-butyl acrylate (14 grams, 0.11 mol). The molecular weight properties of the resulting random copolymer poly(styrene-con-butylacrylate-co-chloromethylstyrene) having a monomer ratio of 86.0 percent styrene, 4.6 percent n-butylacrylate, 9.3 percent chloromethylstyrene (isomer mixture) by mole are shown in Table XX.

SYNTHETIC EXAMPLE III

This procedure of Synthetic Example I was repeated to generate another chloromethylstyrene (5 to 15 mol percent) containing polymer, using the following amounts of monomers: styrene (200 grams, 1.92 mol), chloromethylstyrene (isomer mixture, 48 grams, 0.33 mol), and n-butyl acrylate (14 grams, 0.11 mol). The molecular weight properties of the resulting random copolymer poly(styrene-con-butylacrylate-co-chloromethylstyrene) having a monomer ratio of 81.4 percent styrene, 4.7 percent n-butylacrylate, 14.0 percent chloromethylstyrene (isomer mixture) by mole are shown in Table XX.

SYNTHETIC EXAMPLE IV

A dimethylaminoethyl methacrylate (DMAEMA) containing polymer was prepared as follows. A solution of styrene (91 grams, 0.87 mol) and DMAEMA (dimethylaminoethyl methacrylate) (15.2 grams, 0.10 mol, obtained from Aldrich Chemical), 2,2'-azobis(2-methylpropionitrile), (AIBN, 0.50 gram, 0.0030 mol, obtained from Aldrich Chemical) and TEMPO (0.524 gram, 0.0033 mol) was stirred and heated, under argon, in an oil bath maintained at 135° C. for 6 hours. The resultant polymeric material was isolated by precipitation into stirring methanol and recovered as a coarse powder. Recovered polymer was then dried in vacuo at room temperature for 24 hours which resulted in the isolation of a fine white free flowing powder. The molecular weight properties of the resulting random copolymer, poly(styrene-co-DMAEMA) having a monomer ratio of 89.7 percent styrene, 10.3 percent DMAEMA by mole are shown in Table XX.

SYNTHETIC EXAMPLE V

A quaternary ammonium chloride ionomer was prepared by the following method. 40 Grams of the chloromethylstyrene containing polymer prepared in Synthetic Example I were dissolved in a solvent of 300 milliliters of THF and 100 milliliters of methanol. 10 Milliliters of triethyl amine, obtained from Aldrich Chemical, were added and the solution was refluxed (75° C.) for 3 hours. Solvent was removed and the resulting polymer was recovered as a coarse powder. Recovered polymer was then dried in vacuo at room temperature for 24 hours which resulted in the isolation of a brittle slightly yellow granular powder which was then mechanically ground. The resulting random copolymer of poly(styrene-co-n-butylacrylate-co-chloromethylstyrene-co triethylammonium methylstyrene chloride) had a monomer ratio of 90.7 percent styrene, 4.6 percent n-butylacrylate, 2.3 percent chloromethylstyrene, 2.3 percent triethylammonium methylstyrene chloride, by mole.

SYNTHETIC EXAMPLE VI

A quaternary ammonium chloride ionomer was prepared by the method of Synthetic Example V, except that the chloromethylstyrene containing polymer prepared in Synthetic Example II was used. The resulting copolymer was comprised of a random copolymer poly(styrene-co-n-butylacrylate-co-ch loromethylstyrene-co triethylammonium methylstyrene chloride) having a monomer ratio of 86.0 percent styrene, 4.6 percent n-butylacrylate, 4.6 percent chloromethylstyrene, 4.6 percent triethylammonium methylstyrene chloride, by mole.

SYNTHETIC EXAMPLE VII

A quaternary ammonium chloride ionomer was prepared by the method of Synthetic Example V, except that the chloromethylstyrene containing polymer prepared in Synthetic Example III was used. The resulting copolymer was a random copolymer of poly(styrene-co-n-butylacrylate-co-chloromethylstyrene-co triethylammonium methylstyrene chloride) had a monomer ratio of 81.4 percent styrene, 4.6 percent n-butylacrylate, 7.0 percent chloromethylstyrene, 7.0 percent triethylammonium methylstyrene chloride, by mole.

SYNTHETIC EXAMPLE VII

A pyridinium chloride ionomer was prepared using the following method. 40 Grams of the chloromethylstyrene containing polymer prepared in Synthetic Example I was dissolved in a solvent consisting of 300 milliliters of THF and 100 milliliters of methanol. 10 Milliliters of pyridine, obtained from Aldrich Chemical, was added and the solution was refluxed (75° C.) for 3 hours. Solvent was removed and the resulting polymer was recovered as a coarse powder. Recovered polymer was then dried in vacuo at room temperature for 24 hours which resulted in the isolation of a brittle slightly yellow granular powder which was then mechanically ground. The resulting random copolymer of poly(styrene-co-n-butylacrylate-co-chloromethylstyrene-co pyridinium methylstyrene chloride) having a monomer ratio of 90.7 percent styrene, 4.6 percent n-butylacrylate, 2.3 percent chloromethylstyrene, 2.3 percent pyridinium methylstyrene chloride, by mole.

SYNTHETIC EXAMPLE IX

A pyridinium chloride ionomer was prepared by the method of Synthetic Example VIII, except that the chloromethylstyrene containing polymer prepared in Synthetic Example II was used. The resulting copolymer was a random copolymer of poly(styrene-co-n-butylacrylate-co-chloromethylstyrene-co pyridinium methylstyrene chloride) having a monomer ratio of 86.0 percent styrene, 4.6 percent n-butylacrylate, 4.6 percent chloromethylstyrene, 4.6 percent pyridinium methylstyrene chloride, by mole.

SYNTHETIC EXAMPLE X

A pyridinium chloride ionomer was prepared by the method of Synthetic Example VIII, except that the chloromethylstyrene containing polymer prepared in Synthetic Example III was used. The resulting copolymer was a random copolymer of poly(styrene-con-butylacrylate-co-chloromethylstyrene-co pyridinium methylstyrene chloride) having a monomer ratio of 81.4 percent styrene, 4.6 percent n-butylacrylate, 7.0 percent chloromethylstyrene, 7.0 percent pyridinium methylstyrene chloride, by mole.

TABLE XX

Molecular Weight Data (by GPC vs polystyrene standards in

| EXAMPLE | $M_n \times 10^{-3}$ | $M_w \times 10^{-3}$ | $M_p \times 10^{-3}$ | PD |
|---|---|---|---|---|
| I | 17.9 | 22.4 | 24.8 | 1.25 |
| II | 18.7 | 25.0 | 25.9 | 1.34 |
| III | 16.7 | 22.3 | 20.5 | 1.33 |
| IV | 13.6 | 18.8 | 19.8 | 1.38 |

SYNTHETIC EXAMPLE XI (SOLUTION POLYMERIZATION)

A dimethylaminoethyl methacrylate (DMAEMA) containing polymer was prepared as follows. A solution of methyl methacrylate (MMA; 425 grams; obtained from Aldrich Chemical), DMAEMA (75 grams, obtained from Aldrich Chemical), toluene (750 grams), and 2,2'-azobis(2,4-dimethylpentanenitrile) (Vazo-52; 2 grams, obtained from DuPont Chemicals) was stirred and heated, under nitrogen, in a water bath maintained at 60° C. for 7 hours. There was added to the mixture an additional 0.5 gram of Vazo-52, and the temperature was maintained for an additional 7 hours. A portion of polymeric material was isolated by placing a 250 gram sample of the final reaction slurry in a fume hood, and evaporating the toluene. The resulting polymer was ground with a coffee grinder, and was then dried in vacuo at 50° C. for 6 hours. The final product was a coarse white powder. The resulting random copolymer was PMMA-coDMAEMA having a monomer ratio of 90 percent MMA, and 10 percent DMAEMA by mole.

SYNTHETIC EXAMPLE XII (CARBON BLACK BLEND)

A blend was prepared of the copolymer from Synthetic Example XI with carbon black. Conductex SC Ultra (55 grams, obtained from Colombian Chemicals), and toluene (350 grams), were added to a 680 gram sample of the final reaction slurry from Synthetic Example XI. The solution was mixed at 10,000 rpm for 2 minutes using a Brinkmann Polytron blender. The polymeric material was isolated by placing the solution in a fume hood, and evaporating the toluene. The resulting polymer product was ground with a coffee grinder, and was then dried in vacuo at 50° C. for 6 hours. The final product was a coarse black powder containing 18 percent carbon black by weight, and the remainder being polymer.

SYNTHETIC EXAMPLE XIII (SOLUTION POLYMERIZATION)

A chloromethylstyrene (CMS) containing polymer was prepared as follows. A solution of methyl methacrylate (MMA, 462.5 grams, obtained from Aldrich Chemical), CMS (37.5 grams, obtained from Dow Chemical), toluene (750 grams), and 2,2'-azobis(2,4-dimethylpentanenitrile) (Vazo-52, 2 grams, obtained from DuPont Chemical) was stirred and heated, under nitrogen, in a water bath maintained at 60° C. for 7 hours. 0.5 Gram of Vazo-52 was then added, and the temperature was maintained for an additional 7 hours. A portion of polymeric material was isolated by placing a 250 gram sample of the above slurry in a fume hood, and evaporating the toluene. The resulting polymer product was ground with a coffee grinder, and was then dried in vacuo at 50° C. for 6 hours. The final product was a coarse white powder. The resulting random copolymer was PMMA-co-CMS having a monomer ratio of 95 percent MMA, and 5 percent CMS by mole.

SYNTHETIC EXAMPLE XIV (CARBON BLACK BLEND)

A blend was prepared of the copolymer from Synthetic Example XIII with carbon black. Conductex SC Ultra (55 grams, obtained from Colombian Chemicals), and toluene (350 grams), were added to a 680 gram sample of the final reaction slurry from Synthetic Example XIII. The solution was mixed at 10,000 rpm for 2 minutes using a Brinkmann Polytron blender. The polymeric material was isolated by placing the slurry in a fume hood, and evaporating the toluene. The resulting polymer product was ground with a coffee grinder, and was then dried in vacuo at 50° C. for 6 hours. The final product was a coarse black powder containing 18 percent carbon black by weight.

SYNTHETIC EXAMPLE XV (SUSPENSION POLYMERIZATION)

A diisopropylaminoethyl methacrylate (DIAEMA) containing polymer was prepared as follows. A solution of methyl methacrylate (MMA, 119.7 grams, obtained from Aldrich Chemical), DIAEMA (44.6 grams, obtained from Scientific Polymer Products), and 2,2'-azobis(2,4-dimethylpentanenitrile) (Vazo-52, 0.6 gram, obtained from DuPont Chemicals) was mixed into a solution of water (487 grams), Airvol 603 polyvinyl alcohol (13 grams, obtained from Air Products), and potassium iodide (5.5 grams, obtained from West Agro). This was mixed at 10,000 rpm for 5 minutes using a Brinkmann Polytron blender. The slurry was stirred and heated, under nitrogen, in a 1 liter stainless steel reaction vessel maintained at 60° C. for 6 hours. The final slurry was washed by adding a mixture of methanol (675 grams) and water (75 grams), centrifuging, and decanting the supernatant. This was repeated three times, and a final wash was accomplished using only water (750 grams). The resulting polymer was air dried at 50° C., then drying was completed in vacuo at 50° C. for 6 hours. The product was then ground with a coffee grinder. The final product was a fine, free-flowing white powder. The resulting random copolymer was PMMA-co-DIAEMA having a monomer ratio of 85 percent MMA, and 15 percent DMAEMA by mole.

SYNTHETIC EXAMPLE XVI (SEMISUSPENSION POLYMERIZATION)

A chloromethylstyrene (CMS) containing polymer was prepared as follows. A solution of methyl methacrylate (MMA, 204.5 grams, obtained from Aldrich Chemical), CMS (17.3 grams, obtained from Dow Chemical), trimethoxysilylpropyl methacrylate (TMSPMA, 28.3 grams, obtained from Aldrich Chemical), toluene (375 grams), and 2,2'-azobis(2,4-dimethylpentanenitrile) (Vazo-52, 2 grams, obtained from DuPont Chemical) was stirred and heated, under nitrogen, in an water bath maintained at 60° C. for 7 hours. 0.5 Gram of Vazo-52 was then added, and the temperature was maintained for an additional 7 hours. Conductex SC Ultra (45 grams, obtained from Colombian Chemicals), and toluene (130 grams) were added to a 75 gram sample of the final slurry from the above reaction. The resulting mixture was stirred at 8,000 rpm for 1 minute using a Brinkmann Polytron blender. The polymeric material was isolated by placing the slurry in a fume hood, and evaporating the toluene. The resulting polymer was ground with a coffee grinder, and was then dried in vacuo at 50° C. for 6 hours. The final product was a coarse black polymer powder (throughout) hereafter referred to as SOLP.

A solution of methyl methacrylate (MMA, 105 grams, obtained from Aldrich Chemical), CMS (13 grams, obtained from Aldrich Chemical), and SOLP (63 grams from above reaction) were stirred for 16 hours at room temperature. 2,2'-Azobis(2,4-dimethylpentanenitrile) (Vazo-52, 5.2 grams, obtained from DuPont Chemicals), 2,2'-azobis(2,4-dimethylbutyronitrile) (Vazo-67, 2.6 grams, obtained from DuPont Chemicals), and benzoyl peroxide (Lucidol-75, 3.6 grams, obtained from Queen City Chemicals) was mixed into the solution and stirred for 2 hours. The solution was added to a mixture of water (429 grams), Airvol 603 polyvinyl alcohol (11 grams, obtained from Air Products), and potassium iodide (5 grams, obtained from West Agro). The mixture was then mixed at 10,000 rpm for 5 minutes using a Brinkman Polytron blender. The slurry was stirred and heated, under nitrogen, in a 1 liter stainless steel reaction vessel maintained at 60° C. for 1.5 hours and then 85° C. for 1.5 hours. The final slurry was washed by mixing with a mixture of methanol (620 grams) and water (70 grams), centrifuging, and decanting the supernatant. This was repeated three times on, and then a final wash was dried using only water (690 grams). The resulting polymer was dried in vacuo at 50° C. for 6 hours, and was then ground with a coffee grinder. The final product was a fine, free-flowing black powder. The resulting random copolymer was PMMA-co-CMS-co-TMSPMA having a monomer ratio of 92 percent MMA, 7 percent CMS, and 1 percent TMSPMA by mole. The polymer contained 18 percent carbon black by weight.

CARRIER EXAMPLE I

In the first step of the solution coating process, 22.70 grams of poly(styrene-co-n-butylacrylate-co-chloromethylstyrene-co-triethylammonium methylstyrene chloride) prepared in Synthetic Example V having a monomer ratio of 90.7 percent styrene, 4.6 percent n-butylacrylate, 2.3 percent chloromethylstyrene, 2.3 percent triethylammonium methylstyrene chloride, by mole, is dissolved in 90.8 grams of MEK via roll mill until the polymer is adequately dissolved. The solids concentration is therefore 20.00 by weight. The dissolved polymer in the solvent is known as the "lacquer". In the second step of the solution coating process, 2,270 grams of spherical steel core with a volume median diameter of 100 microns (obtained from Nuclear Metals, Inc.) is added to a Vibratub and heated by a heat gun to 1 760F. The Vibratub is turned on to begin vibration. The lacquer is then slowly added to the hot core and the solvent flashes off. The core and lacquer is agitated by the vibration from the Vibratub and by spatula tools to help agitate the material and to eliminate the residual solvent. The product was then spread out on an aluminum tray and vacuum dried for several hours. The product was then screened through an 84 TBC (Tensile Bolt Cloth) mesh screen to remove any large agglomerates. The final product was comprised of a steel carrier core with a total of 1.0 percent of poly(styrene-co-n-butylacrylate-co-chloromethylstyrene-co-triethylammonium methylstyrene chloride) (90.7/4.6/2.312.3 monomer ratio) by weight on the surface.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol-A propylene oxide fumarate polymer, and 10 weight percent of REGAL 33® carbon black (90/10). Thereafter, the triboelectric charge on the carrier particles was determined by the known Faraday Cage process, and there was measured on the carrier a charge of 24.3 microcoulombs per gram. Further, the conductivity of the carrier as determined by forming a 0.1 inch long magnetic brush of the carrier particles, and measuring the conductivity by imposing a 10 volt potential across the brush was 2.91 $E^{14}$ mho-cm-$^{31\ 1}$. Therefore, these carrier particles were insulative.

As a comparison, a carrier was coated in the same manner as above with poly(chloromethylstyrene-co-n-butylacrylate-co-styrene) in a monomer ratio of 4.6 percent/4.6 percent/90.7 percent prepared in Synthetic Example I, that is, the unquaternized version of the carrier coating polymer. The triboelectric charge on the carrier particles was determined by the known Faraday Cage process, and there was measured on the carrier a charge of 1.4 microcoulombs per gram, that is, approximately 23 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.56 $E^{-14}$ mho-cm$^{-14}$. Therefore, these carrier particles were insulative.

CARRIER EXAMPLE II

In the first step of the solution coating process, 22.70 grams of poly(styrene-co-n-butylacrylate-co-chloromethylstyrene-co pyridinium methylstyrene chloride) prepared in Synthetic Example VIII having a monomer ratio of 90.7 percent styrene, 4.6 percent n-butylacrylate, 2.3 percent chloromethylstyrene, 2.3 percent pyridinium methylstyrene chloride, by mole, were dissolved in 90.8 grams of MEK via roll mill until the polymer was adequately dissolved. The solids concentration was, therefore, 20.00 by weight. The remainder of the solution coating process was substantially identical to that of Carrier Example I. The final product was comprised of a carrier core with a total of 1.0 percent of poly(styrene-co-n-butylacrylate-co-chloromethylstyrene-co pyridinium methylstyrene chloride) (90.7/4.6/2.3/2.3 monomer ratio) by weight on the surface.

A developer composition was then prepared in the same manner as that of Carrier Example I. Thereafter, the triboelectric charge on the carrier particles was determined by the known Faraday Cage process, and there was measured on the carrier a charge of 20.0 microcoulombs per gram. Further, the conductivity of the carrier as determined by forming a 0.1 inch long magnetic brush of the carrier particles, and measuring the conductivity by imposing a 10 volt potential across the brush was 3.09 $E^{-14}$ mho-cm-$^{-1}$. Therefore, these carrier particles were insulative.

As a comparison, a carrier was coated in the same manner as above with poly(chloromethylstyrene-co-n-butylacrylate-co-styrene) in a monomer ratio of 4.6 percent/4.6 percent/90.7 percent prepared in Synthetic Example I, that is, the unquaternized version of the carrier coating polymer. The triboelectric charge on the carrier particles was determined by the known Faraday Cage process, and there was measured on the carrier a charge of 1.4 microcoulombs per gram, that is, approximately 18.5 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.56 $E^{-14}$ mho-cm$^{-1}$. Therefore, these carrier particles were insulative.

CARRIER EXAMPLE III

In the first step of the solution coating process, 22.70 grams of poly(styrene-co-nbutylacrylate-co-chloromethylstyrene-co-triethylammonium methylstyrene chloride) prepared in Synthetic Example VI having a monomer ratio of 86.0 percent styrene, 4.6 percent n-butylacrylate, 4.6 percent chloromethylstyrene, 4.6 percent triethylammonium methylstyrene chloride, by mole, was dissolved in 90.8 grams of MEK via roll mill until the polymer was adequately dissolved. The solids concentration was therefore 20.00 by weight. The remainder of the solution coating process was substantially identical to that of Carrier Example I. The final product was comprised of a carrier core with a total of 1.0 percent of poly(styrene-co-nbutylacrylate-co-chloromethylstyrene-co-triethylammonium methylstyrene chloride) (86.0/4.6/4.6/4.6 monomer ratio) by weight on the surface.

A developer composition was then prepared in the same manner as that of Carrier Example I. Thereafter, the triboelectric charge on the carrier particles was determined by the known Faraday Cage process, and there was measured on the carrier a charge of 21.1 microcoulombs per gram. Further, the conductivity of the carrier as determined by forming a 0.1 inch long magnetic brush of the carrier particles, and measuring the conductivity by imposing a 10 volt potential across the brush was 1.38 $E^{-14}$ mho-cm$^{-1}$. Therefore, these carrier particles were insulative.

As a comparison, a carrier was coated in the same manner as above with poly(chloromethylstyrene-co-n-butylacrylate-co-styrene) in a monomer ratio of 9.3 percent/4.6 percent/86.0 percent prepared in Synthetic Example II, that is, the unquaternized version of the carrier coating polymer. The triboelectric charge on the carrier particles was determined by the known Faraday Cage process, and there was measured on the carrier a charge of 4.4 microcoulombs per gram, that is, approximately 16.7 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.51 $E^{-14}$ mho-cm$^{-1}$. Therefore, these carrier particles were insulative.

CARRIER EXAMPLE IV

In the first step of the solution coating process, 22.70 grams of poly(styrene-co-n-butylacrylate-co-chloromethylstyrene-co pyridinium methylstyrene chloride) prepared in Synthetic Example IX having a monomer ratio of 90.7 percent styrene, 4.6 percent n-butylacrylate, 2.3 percent chloromethylstyrene, 2.3 percent pyridinium methylstyrene chloride, by mole, was dissolved in 90.8 grams of MEK (methylethyl ketone) via roll mill until the polymer was adequately dissolved. The solids concentration was therefore 20.00 by weight. The remainder of the solution coating process was substantially identical to that of Carrier Example I. The final product was comprised of a carrier core with a total of 1.0 percent of poly(styrene-co-n-butylacrylate-co-chloromethylstyrene-co pyridinium methylstyrene chloride) (90.7/4.6/2.3/2.3 monomer ratio) by weight on the surface.

A developer composition was then prepared in the same manner as that of Carrier Example I. Thereafter, the triboelectric charge on the carrier particles was determined by the known Faraday Cage process, and there was measured on the carrier a charge of 17.0 microcoulombs per gram. Further, the conductivity of the carrier as determined by forming a 0.1 inch long magnetic brush of the carrier particles, and measuring the conductivity by imposing a 10 volt potential across the brush was 4.9 $E^{-15}$ mho-cm$^{-1}$. Therefore, these carrier particles were insulative.

As a comparison, a carrier was coated in the identical manner as above with poly(chloromethylstyrene-co-n-butylacrylate-co-styrene) in a monomer ratio of 9.3 percent/4.6 percent/86.0 percent prepared in Synthetic Example II, that is, the unquaternized version of the carrier coating polymer. The triboelectric charge on the carrier particles was determined by the known Faraday Cage process, and there was measured on the carrier a charge of 4.4 microcoulombs per gram, that is, approximately 12.6 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.51 $E^{-14}$ mho-$cm^{-1}$. Therefore, these carrier particles were insulative.

CARRIER EXAMPLE V

In the first step of the solution coating process, 22.70 grams of poly(styrene-co-nbutylacrylate-co-chloromethylstyrene-co-triethylammonium methylstyrene chloride) prepared in Synthetic Example VII having a monomer ratio of 81.4 percent styrene, 4.6 percent n-butylacrylate, 7.0 percent chloromethylstyrene, 7.0 percent triethylammonium methylstyrene chloride, by mole, was dissolved in 90.8 grams of MEK via roll mill until the polymer was adequately dissolved. The solids concentration was therefore 20.00 by weight. The remainder of the solution coating process was substantially identical to that of Carrier Example I. The final product was comprised of a carrier core with a total of 1.0 percent of poly(styrene-co-nbutylacrylate-co-chloromethylstyrene-co-triethylammonium methylstyrene chloride) (81.4/4.6/7.0/7.0 monomer ratio) by weight on the surface.

A developer composition was then prepared in the same manner as that of Carrier Example I. Thereafter, the triboelectric charge on the carrier particles was determined by the known Faraday Cage process, and there was measured on the carrier a charge of 19.6 microcoulombs per gram. Further, the conductivity of the carrier as determined by forming a 0.1 inch long magnetic brush of the carrier particles, and measuring the conductivity by imposing a 10 volt potential across the brush was 1.36 $E^{-19}$ mho-$cm^{-1}$. Therefore, these carrier particles were conductive.

As a comparison, a carrier was coated in the identical manner as above with poly(chloromethylstyrene-co-n-butylacrylate-co-styrene) in a monomer ratio of 14.0 percent/4.7 percent/81.4 percent prepared in Synthetic Example III, that is, the unquaternized version of the carrier coating polymer. The triboelectric charge on the carrier particles was determined by the known Faraday Cage process, and there was measured on the carrier a charge of 1.4 microcoulombs per gram, that is, approximately 18.2 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.02 $E^{-14}$ mho-$cm^{-1}$. Therefore, these carrier particles were insulative.

CARRIER EXAMPLE VI

In the first step of the solution coating process, 22.70 grams of poly(styrene-co-n-butylacrylate-co-chloromethylstyrene-co-pyridinium methylstyrene chloride) prepared in Synthetic Example X having a monomer ratio of 81.4 percent styrene, 4.6 percent n-butylacrylate, 7.0 percent chloromethylstyrene, 7.0 percent pyridinium methylstyrene chloride, by mole, was dissolved in 90.8 grams of MEK via roll mill until the polymer was adequately dissolved. The solids concentration was therefore 20.00 by weight. The remainder of the solution coating process was substantially identical to that of Carrier Example I. The final product was comprised of a carrier core with a total of 1.0 percent of poly(styrene-co-n-butylacrylate-co-chloromethylstyrene-co-pyridinium methylstyrene chloride) (81.4/4.6/7.0/7.0 monomer ratio) by weight on the surface.

A developer composition was then prepared in the same manner as that of Carrier Example I. Thereafter, the triboelectric charge on the carrier particles was determined by the known Faraday Cage process, and there was measured on the carrier a charge of 19.0 microcoulombs per gram. Further, the conductivity of the carrier as determined by forming a 0.1 inch long magnetic brush of the carrier particles, and measuring the conductivity by imposing a 10 volt potential across the brush was 2.54 $E^{-11}$ mho-$cm^{-1}$. Therefore, these carrier particles were conductive.

As a comparison, a carrier was coated in the identical manner as above with poly(chloromethylstyrene-co-n-butylacrylate-co-styrene) in a monomer ratio of 14.0 percent/4.7 percent/81.4 percent prepared in Synthetic Example III, that is, the unquaternized version of the carrier coating polymer. The triboelectric charge on the carrier particles was determined by the known Faraday Cage process, and there was measured on the carrier a charge of 1.4 microcoulombs per gram, that is, approximately 17.6 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.02 $E^{-14}$ mho-$cm^{-1}$. Therefore, these carrier particles were insulative.

CARRIER EXAMPLE VII

In the first step of the solution coating process, 7.9 grams of poly(styrene-co-dimethylaminoethyl methacrylate) prepared in Synthetic Example IV with a monomer ratio of 89.7/10.3 and 7.9 grams of poly(chloromethylstyrene-co-n-butylacrylate-co-styrene) prepared in Synthetic Example I with a monomer ratio of 4.6/4.6/90.7 were dissolved in 63.6 grams of MEK via roll mill until the polymers were adequately dissolved. The solids concentration was therefore 20.00 by weight. The dissolved polymer in the solvent is known as the "lacquer". In the second step of the solution coating process, 1,589 grams of a spherical steel core with a volume median diameter of 100 microns (obtained from Nuclear Metals, Inc.) was added to a Vibratub and heated by a heat gun to 168° F. The Vibratub was turned on to begin vibration. The lacquer was then slowly added to the hot core and the solvent flashes off. The core and lacquer were agitated by the vibration from the Vibratub and by spatulas to eliminate the residual solvent. The product was then spread out on an aluminum tray and vacuum dried for several hours at an elevated temperature (above 100° F.) to induce a crosslinking reaction between the two polymers on the surface of the carrier. The resulting crosslinked product was then screened through an 84 TBC (Tensile Bolt Cloth) mesh screen to remove any large agglomerates. The final product was comprised of a carrier core with a total of 1.00 percent of the above polymer by weight.

A developer composition was then prepared in the same manner as that of Carrier Example I. Thereafter, the triboelectric charge on the carrier particles was determined by the known Faraday Cage process, and there was measured on the carrier a charge of 29.4 microcoulombs per gram. Further, the conductivity of the carrier as determined by forming a 0.1 inch long magnetic brush of the carrier particles, and measuring the conductivity by imposing a 10 volt potential across the brush was 3.05 $E^{-14}$ mho-cm$^{-1}$. Therefore, these carrier particles were insulative.

As a comparative example, a carrier was coated in the same manner as above with poly(chloromethylstyrene-co-n-butylacrylate-co-styrene) in a monomer ratio of 4.6/4.6/90.7 percent prepared in Synthetic Example I, that is, the first of the two polymer that comprise the crosslinked polymer on the surface of the core. The triboelectric charge on the carrier particles was determined by the known Faraday Cage process, and there was measured on the carrier a charge of 1.4 microcoulombs per gram, that is, approximately 28.0 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.02 $E^{-14}$ mho-cm$^{-1}$. Therefore, these carrier particles were insulative.

As a second comparative example, a carrier was coated in the same manner as above with poly(styrene-co-dimethylaminoethyl methacrylate) in a monomer ratio of 89.7/10.3 percent prepared in Synthetic Example IV, that is, the second of the two polymer that comprise the crosslinked polymer on the surface of the core. The triboelectric charge on the carrier particles was determined by the known Faraday Cage process, and there was measured on the carrier a charge of 18.0 microcoulombs per gram, that is, approximately 11.4 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.0 $E^{-14}$ mho-cm$^{-1}$. Therefore, these carrier particles were insulative.

CARRIER EXAMPLE VIII

In the first step of the carrier coating process, a terpolymer obtained from Goodyear Tire and Rubber Company composed of 90.5 percent by weight styrene, 9.0 percent by weight of butadiene, and 0.5 percent by weight of dimethylaminoethyl methacrylate dimethylsulfate quaternary ammonium complex with a molecular weight of $M_w$=51,500, $M_n$=15,800, MWD=3.3 was ground down to a volume median average particle size of 7.34 microns in a 15" Sturtevent jet mill, under the conditions of 120 psi feed pressure, 120 psi gring pressure, and flood feeding. 44.91 Grams of the resulting polymer powder was then mixed with 4,491.09 grams of a spherical steel core with a volume median diameter of 100 microns (Nuclear Metals, Inc.). The mixing was accomplished in a M5R blender with the following process conditions: blender speed of 50 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 350° F. thereby causing the polymers to melt and fuse to the core. The product from the kiln was screened through an 84 TBC (Tensile Bolt Cloth) mesh screen to remove any large agglomerates. The final product was comprised of a carrier core with a total of 1.0 percent coating weight polymer of poly(styrene/butadiene/DMAEMA dimethylsulfate quaternary ammonium complex) (90.5 percent/9.0 percent/0.5 percent monomer ratio) by weight on the surface.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer, and 10 weight percent of REGAL 3309® carbon black. Thereafter, the triboelectric charge on the carrier particles was determined by the known Faraday Cage process, and there was measured on the carrier a charge of 4.5 microcoulombs per gram. Further, the conductivity of the carrier as determined by forming a 0.1 inch long magnetic brush of the carrier particles, and measuring the conductivity by imposing a 10 volt potential across the brush was too insulating to be measured (>$10^{-15}$ mho-cm$^{-1}$).

As a comparative example, a carrier of the same composition as above except that the coating polymer consisted of a copolymer of 87 percent by weight styrene and 13 percent by weight butadiene with a number average molecular weight of about 16,000 and a weight average molecular weight of about 140,000 was processed in the manner identical to that above. The final product was comprised of a carrier core with a total of 1.0 percent coating weight polymer of poly(styrene/butadiene) (87 percent/13 percent monomer ratio) by weight on the surface. A developer composition was then prepared in the same manner as above. Thereafter, the triboelectric charge on the carrier particles was determined by the known Faraday Cage process, and there was measured on the carrier a charge of 3.4 microcoulombs per gram, that is, approximately 1.1 microcoulombs per gram lower than the triboelectric value for the carrier coated with the quaternized version of the polymer. Further, the conductivity of the carrier as determined by forming a 0.1 inch long magnetic brush of the carrier particles, and measuring the conductivity by imposing a 10 volt potential across the brush was 3.02 $E^{-14}$ mho-cm$^{-1}$.

CARRIER EXAMPLE IX

In the first step of the solution coating process, 1.25 grams of PMMA-co-DMAEMA prepared in Synthetic Example XI (monomer ratio of 90/10 mol percent) and 1.25 grams of PMMA-co-CMS prepared in Synthetic Example XIII (monomer ratio of 95/5 mol percent) were dissolved in 250 grams of MEK via roll mill until the polymer was adequately dissolved. The solids concentration was therefore 10 percent by weight. The dissolved polymer in the solvent was known as the "lacquer". In the second step of the solution coating process, 250 grams of spherical steel core with a volume median diameter of 100 microns (obtained from Nuclear Metals, Inc.) was added to a beaker and heated in an oven at 80° C. for 16 hours. The lacquer was then slowly added to the hot core and the solvent flashes off. The core and lacquer is stirred with a spatula until excess solvent has evaporated. The product was then spread out on an aluminum tray and vacuum dried for several hours at an elevated temperature (above 180° C.) to induce a crosslinking reaction between the two polymers on the surface of the carrier. The resulting crosslinked product was then screened through an 84 TBC (Tensile Bolt Cloth) mesh screen to remove any large agglomerates. The final product was comprised of a carrier core with a total of 1.0 percent by weight of PMMA-co-DMAEMA (90/10 mol percent) and PMMA-co-CMS (95/5 mol percent) crosslinked on the surface of the core.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer, 90 weight percent, and 10 weight percent of REGAL 330® carbon black. Thereafter, the triboelectric charge on the carrier particles was determined by the known Faraday Cage process, and there was measured on the carrier a charge of 95.9 microcoulombs per gram.

CARRIER EXAMPLE X

In the first step of the solution coating process, 1.25 grams of PMMA-co-DMAEMA and carbon black prepared in Synthetic Example XII (monomer ratio of 90/10 mol percent) and 1.25 grams PMMA-co-CMS and carbon black prepared in Synthetic Example XIV (monomer ratio of 95/5 mol percent) were dissolved in 250 grams of MEK via roll mill until the polymer was adequately dissolved. The solids concentration was therefore 10 percent by weight. The dissolved polymer in the solvent was known as the "lacquer". In the second step of the solution coating process, 250 grams of spherical steel core with a volume median diameter of 100 microns (obtained from Nuclear Metals, Inc.) was added to a beaker and heated in an oven at 80° C. for 16 hours. The lacquer was then slowly added to the hot core and the solvent flashes off. The core and lacquer were stirred with a spatula until excess solvent had evaporated. The product was then spread out on an aluminum tray and vacuum dried for several hours at an elevated temperature (above 180° C.) to induce a crosslinking reaction between the two polymers on the surface of the carrier. The resulting crosslinked product was then screened through an 84 TBC (Tensile Bolt Cloth) mesh screen to remove any large agglomerates. The final product was comprised of a carrier core with a total of 1.0 percent by weight of the polymers PMMA-co-DMAEMA (90/10 mol percent) and PMMA-co-CMS (95/5 mol percent) blended with carbon black crosslinked on the surface on the core.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer, 90 weight percent, and 10 weight percent of REGAL 3300® carbon black. Thereafter, the triboelectric charge on the carrier particles was determined by the known Faraday Cage process, and there was measured on the carrier a charge of 44.7 microcoulombs per gram. Further, the conductivity of the carrier as determined by forming a 0.1 inch long magnetic brush of the carrier particles, and measuring the conductivity by imposing a 10 volt potential across the brush was 3.9 $E^{-11}$ mho-cm$^{-1}$. Therefore, these carrier particles were semiconductive.

CARRIER EXAMPLE XI

In the first step of the solution coating process, 0.8 gram of PMMA-co-DIAEMA prepared in Synthetic Example XV (monomer ratio of 85/15 mol percent) and 1.2 grams of PMMA-co-CMS and carbon black prepared in Synthetic Example XVI (monomer ratio of 92/7/1 mol percent) were dissolved in 250 grams of MEK via roll mill until the polymer was adequately dissolved. The solids concentration was therefore 10 percent by weight. The dissolved polymer in the solvent was known as the "lacquer". In the second step of the solution coating process, 250 grams of spherical steel core with a volume median diameter of 100 microns (obtained from Nuclear Metals, Inc.) was added to a beaker and heated in an oven at 80° C. for 16 hours. The lacquer was then slowly added to the hot core and the solvent flashed off. The core and lacquer was stirred with a spatula until excess solvent had evaporated. The product was then spread out on an aluminum tray and vacuum dried for several hours at an elevated temperature (above 180° C.) to induce a crosslinking reaction between the two polymers on the surface of the carrier. The resulting crosslinked product was then screened through an 84 TBC (Tensile Bolt Cloth) mesh screen to remove any large agglomerates. The final product was comprised of a carrier core with a total of 1.0 percent by weight of PMMA-co-DIAEMA (85/15 mol percent) and PMMA-co-CMS-co-TMSPMA (92/7/1 mol percent) crosslinked on the surface of the carrier.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol-A propylene oxide fumarate polymer, 92 weight percent, and 8 weight percent of REGAL 330® carbon black. Thereafter, the triboelectric charge on the carrier particles was determined by the known Faraday Cage process, and there was measured on the carrier a charge of 60.9 microcoulombs per gram. Further, the conductivity of the carrier as determined by forming a 0.1 inch long magnetic brush of the carrier particles, and measuring the conductivity by imposing a 10 volt potential across the brush was 6.0 $E^{-11}$ mho-cm$^{-1}$. Therefore, these carrier particles were semiconductive.

CARRIER EXAMPLE XII

In the first step of the solution coating process, 0.4 gram of PMMA-co-DIAEMA prepared in Synthetic Example XV (monomer ratio of 85/15 mol percent) and 1.6 grams of PMMA-co-CMS and carbon black prepared in Synthetic Example XVI (monomer ratio of 9217/1 mol percent) were dissolved in 250 grams of MEK via roll mill until the polymer was adequately dissolved. The solids concentration was 10 percent by weight. The dissolved polymer in the solvent was known as the "lacquer". In the second step of the solution coating process, 250 grams of spherical steel core with a volume median diameter of 100 microns (obtained from Nuclear Metals, Inc.) was added to a beaker and heated in an oven at 80° C. for 16 hours. The lacquer was then slowly added to the hot core and the solvent flashed off. The core and lacquer was stirred with a spatula until excess solvent had evaporated. The product was then spread out on an aluminum tray and vacuum dried for several hours at an elevated temperature (above 180° C.) to induce a crosslinking reaction between the two polymers on the surface of the carrier. The resulting crosslinked product was then screened through an 84 TBC (Tensile Bolt Cloth) mesh screen to remove any large agglomerates. The final product was comprised of a carrier core with a total of 1.0 percent by weight of PMMA-co-DIAEMA (85/15 mol percent) and PMMA-co-CMS-co-TMSPMA (9217/1 mol percent) crosslinked on the surface of the carrier.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol-A propylene oxide fumarate polymer. Thereafter, the triboelectric charge on the carrier particles was determined by the known Faraday Cage process, and there was measured on the carrier a charge of 40.1 microcoulombs per gram. Further, the conductivity of the carrier as determined by forming a 0.1 inch long magnetic brush of the carrier particles, and measuring the conductivity by imposing a 10 volt potential across the brush was 1.9 $E^{-10}$ mho-$cm^{-1}$. Therefore, these carrier particles were semiconductive.

In all the Examples, the triboelectric charging values and the conductivity numbers were obtained in accordance with the aforementioned procedure. Identical means identical or substantially identical, and the carbon black is usually dispersed in the carrier coating copolymer.

Other embodiments and modifications of the present invention may occur to those of ordinary skill in the art subsequent to a review of the present application and the information presented herein; these embodiments modifications, and equivalents, or substantial equivalents thereof, are also included within the scope of the present invention.

What is claimed is:

1. A carrier comprised of a core and a coating of a polymer containing a quaternary ammonium salt group, and wherein said Dolvmer contains a conductive component, and wherein said polymer is prepared by reacrting two appropriate polymers of a reactive halogen containing polymer and a amine containing polymer to form a crosslinked polymer.

2. A carrier in accordance with claim 1 wherein said quaternary ammonium salt is an alkyl or an aryl salt, and the anion is a halogen, sulfate, or phosphate, and wherein salt includes a polymer backbone of methylmethacrylate, styrene, n-butyl acrylate, dialkylaminoalkyl methacrylate, butadiene, vinylbenzyl chloride, or mixtures thereof.

3. A carrier in accordance with claim 1 wherein the halogen polymer contains a vinylbenzyl halide (Br, Cl, I, F), or allyl halide, and the amine copolymer contains an amine of dimethylaminoethyl methacrylate, diethylaminoethyl methacrylate, or vinyl pyridine.

4. A carrier in accordance with claim 1 wherein the polymer is a copolymer of methylmethacrylate or styrene and a vinylbenzyltrialkyl ammonium halide.

5. A carrier in accordance with claim 1 wherein the amine containing polymer is selected in excess, and the resulting polymer contains quaternary ammonium salt crosslinks and free amines.

6. A carrier in accordance with claim 1 wherein the polymer contains from about 0.5 to about 20 weight percent of a quaternary ammonium salt.

7. A carrier in accordance with claim 1 wherein the polymer is of an $M_w$ of from about 50,000 to about 200,000.

8. A carrier in accordance with claim 1 wherein the polymer is a copolymer and the coating weight thereof is from about 0.1 to about 20 weight percent.

9. A carrier in accordance with claim 1 wherein the polymer coating weight is from about 1 to about 3 weight percent.

10. A carrier in accordance with claim 1 wherein the conductive component is a metal oxide, or carbon black.

11. A carrier in accordance with claim 10 wherein said conductive component is carbon black selected in an amount of from about 10 to about 60 weight percent.

12. A carrier in accordance with claim 1 wherein said core is a metal, a metal oxide, or a ferrite.

13. A carrier in accordance with claim 1 with a triboelectric charge of from about a positive 20 to about a positive 100 microcoulombs per gram.

14. A carrier in accordance with claim 1 with a triboelectric charge of from about a positive 30 to about a positive 50 microcoulombs per gram.

15. A developer comprised of the carrier of claim 1 and toner.

16. A developer in accordance with claim 15 wherein the toner is comprised of thermoplastic resin and colorant.

17. A developer in accordance with claim 16 wherein the colorant is a pigment or a dye.

18. A carrier in accordance with claim 1 wherein the carrier contains a second polymer coating.

19. A carrier in accordance with claim 18 wherein the second coating is comprised of styrene acrylate, styrene methacrylate, a fluoropolymer, or mixtures thereof.

20. A carrier in accordance with claim 18 wherein said second coating is comprised of a polyurethane, and which polyurethane optionally contains dispersed therein conductive components.

21. A carrier in accordance with claim 18 wherein the second coating is comprised of a polyurethane/polyester.

22. A method comprising developing an image with the composition of claim 15.

23. A carrier comprised of a core in a coating of a crosslinked polymer, which crosslinked polymer is generated by the reaction of an amine containing polymer and a halogen containing polymer.

24. A carrier in accordance with claim 23 wherein said polymer contains a conductive component.

25. A carrier in accordance with claim 23 wherein said amine containing polymer is poly(dimethylaminoethyl methacrylate)-co-polystyrene, and said halogen containing polymer is polystyrene-co-poly-(n-butylacrylate)-co-poly (vinylbenzyl chloride).

26. A carrier in accordance with claim 23 wherein the amine containing polymer is a homopolymer or copolymer of dialkylaminoalkyl methacrylate, and said halogen containing polymer is a homopolymer or copolymer.

27. A carrier in accordance with claim 26 wherein said halogen containing homopolymer or copolymer is a homopolymer or copolymer of polyvinyl benzyl chloride.

28. A carrier in accordance with claim 26 wherein said halogen containing homopolymer or copolymer is polyvinyl benzyl fluoride, polyvinyl benzyl iodide or polyvinyl benzyl bromide, or wherein said homopolymer or copolymer is an allyl halide.

29. A carrier in accordance with claim 26 wherein said dialkyl amino alkyl methacrylate is dimethylaminoethyl methacrylate, diethylaminoethyl methacrylate, diisopropylaminoethyl methacrylate, or dibutylaminoethyl methacrylate.

30. A carrier in accordance with claim 23 wherein said polymer contains carbon black.

* * * * *